US006818041B2

(12) United States Patent
Tomizawa et al.

(10) Patent No.: US 6,818,041 B2
(45) Date of Patent: Nov. 16, 2004

(54) MAGNETIC ALLOY POWDER FOR PERMANENT MAGNET AND METHOD FOR PRODUCING THE SAME

(75) Inventors: Hiroyuki Tomizawa, Hirakata (JP); Yuji Kaneko, Uji (JP)

(73) Assignee: Neomax Co., Ltd, Osaka (JP)

( * ) Notice: Subject to any disclaimer, the term of this patent is extended or adjusted under 35 U.S.C. 154(b) by 0 days.

(21) Appl. No.: 09/952,056

(22) Filed: Sep. 14, 2001

(65) Prior Publication Data

US 2002/0112783 A1 Aug. 22, 2002

(30) Foreign Application Priority Data

Sep. 18, 2000 (JP) ..... 2000-282412

(51) Int. Cl.[7] ..... B22F 1/00; H01F 1/057

(52) U.S. Cl. ..... 75/252; 75/348; 75/355; 148/101; 148/302

(58) Field of Search ..... 75/252, 348, 355; 148/101, 302

(56) References Cited

U.S. PATENT DOCUMENTS

| | | | | |
|---|---|---|---|---|
| 4,585,473 A | | 4/1986 | Narasimhan et al. | |
| 4,881,986 A | | 11/1989 | Sato et al. | |
| 5,085,716 A | * | 2/1992 | Fuerst et al. | 148/301 |
| 5,162,064 A | * | 11/1992 | Kim et al. | 148/302 |
| 5,225,004 A | | 7/1993 | O'Handley et al. | |
| 5,242,508 A | * | 9/1993 | McCallum et al. | 148/101 |
| 5,811,187 A | * | 9/1998 | Anderson et al. | 148/301 |
| 5,976,271 A | * | 11/1999 | Nomura et al. | 148/103 |

FOREIGN PATENT DOCUMENTS

| | | |
|---|---|---|
| EP | 0 542 529 A1 | 5/1993 |
| JP | 60-017905 | 1/1985 |
| JP | 60-189901 | 9/1985 |
| JP | 64-8205 | 1/1989 |
| JP | 02-070011 | 3/1990 |
| JP | 5-53853 | 8/1993 |
| JP | 7-110966 | 11/1995 |
| WO | WO 00/45397 | 8/2000 |

* cited by examiner

*Primary Examiner*—Ngoclan Mai
(74) *Attorney, Agent, or Firm*—Keating & Bennett, LLP

(57) ABSTRACT

Magnetic alloy powder for a permanent magnet contains: R of about 20 mass percent to about 40 mass percent (R is Y, or at least one type of rare earth element); T of about 60 mass percent to about 79 mass percent (T is a transition metal including Fe as a primary component); and Q of about 0.5 mass percent to about 2.0 mass percent (Q is an element including B (boron) and C (carbon)). The magnetic alloy powder is formed by an atomize method, and the shape of particles of the powder is substantially spherical. The magnetic alloy powder includes a compound phase having $Nd_2Fe_{14}B$ tetragonal structure as a primary composition phase. A ratio of a content of C to a total content of B and C is about 0.05 to about 0.90.

13 Claims, 4 Drawing Sheets

MAGNETIC ALLOY POWDER FOR PERMANENT MAGNET AND METHOD FOR PRODUCING THE SAME

BACKGROUND OF THE INVENTION

The present invention relates to a rare earth magnetic alloy powder used for producing rare earth bonded magnets, sintered magnets, and other suitable magnets that can be applied to various types of motors and actuators, and a permanent magnet manufactured by using such a magnetic alloy powder.

A Nd—Fe—B rare earth magnetic alloy is mass-produced by an ingot casting method or a strip casting method in which a material molten alloy is cooled and solidified, thereby forming a structure including a $Nd_2Fe_{14}B$ tetragonal phase as a primary phase.

In addition to the mass-production technique described above, another technique for producing powder of a Nd—Fe—B type rare earth magnetic alloy by a gas atomize method is disclosed in Japanese Patent Publication Nos. 5-18242, 5-53853, 5-59165, 7-110966, U.S. Pat. No. 4,585,473, for example.

The gas atomize method is a method in which a molten metal alloy is atomized in an inert atmospheric gas, causing free fall of liquid drops of the molten metal alloy so as to manufacture powder particles from the liquid drops of the molten metal alloy. In the gas atomize method, the liquid drops of the molten metal alloy are solidified during the free fall thereof, so that substantially spherical powder particles are produced by this method.

However, in the above-described prior art methods, the powder particles produced by the gas atomize method are only capable of exerting an insufficient coercive force. The reason why a coercive force of the magnetic powder is too low in this method is that a quenching speed required for finely crystallizing a metal alloy of general composition could not be sufficiently attained by the conventional gas atomize method.

In order to obtain a sufficient coercive force that is practically acceptable by using a gas atomize method, it is necessary to perform a process of more finely pulverizing the powder and a sintering process after the atomizing process, or to classify and selectively filter particle sizes of the magnetic powder so as to use only specific lower level particle sizes, which causes penalties in yield. Such additional processes eliminate the advantage of the atomize method that magnetic powder for producing the magnet can be obtained without any pulverizing process, and also causes an additional problem in that the yield is significantly lowered because of the required classification.

For the above-described reasons, the gas atomize method is not practically used as a large quantity production technique of Nd—Fe—B type rare earth magnetic alloy powder. Currently, after a Nd—Fe—B type rare earth magnetic alloy is produced by a melt spinning method, the alloy is pulverized, thereby producing fine powder.

In order to eliminate the disadvantage of the gas atomize method that the quenching speed is insufficient, a secondary atomize method in which liquid drops of molten metal is sprayed on to a cooling plate, is also performed such that the cooling is further accelerated by the cooling plate, as is described in Japanese Laid-Open Patent Publication No 1-8205. According to such a gas atomize method, magnetic powder having magnetic anisotropy can be obtained, and the quenching speed is sufficiently large, so that the structure of alloy is much finer, and the coercive force is increased. In this method, however, molten metal particles which are not completely cooled are strongly sprayed on to the cooling plate, so that there exists a problem in that the shape of the magnetic powder becomes compressed. The compression of the magnetic powder degrades the powder flowability, and significantly reduces the compaction efficiency, so as to greatly decrease the production yield in a press or compacting process and an injection process.

SUMMARY OF THE INVENTION

In order to overcome the problems described above, preferred embodiments of the present invention provide a magnetic alloy powder for a permanent magnet in which the particle shape of powder is prevented from being compressed and maintained to be spherical and the coercive force is greatly increased to a sufficient or more than sufficient level for practical use, and a method for producing the magnetic alloy powder, and provides a permanent magnet manufactured from the magnetic alloy powder for a permanent magnet.

A preferred embodiment of the present invention provides a magnetic alloy powder for a permanent magnet containing:

R of about 20 mass percent to about 40 mass percent (R is Y, or at least one type of rare earth element);

T of about 60 mass percent to about 79 mass percent (T is a transition metal including Fe as a primary component); and Q of about 0.5 mass percent to about 2.0 mass percent (Q is an element including B (boron) and C (carbon)), wherein the magnetic alloy powder is formed by an atomize method, the shape of particles of the powder being spherical, the magnetic alloy powder includes a compound phase having $Nd_2Fe_{14}B$ tetragonal system as a primary composition phase, and a ratio of a content of C to a total content of B and C is within a range of about 0.05 to about 0.90.

In a preferred embodiment, one or more kinds of elements selected from a group consisting of Co, Ni, Mn, Cr, and Al are preferably substituted for part of Fe included in T.

In a preferred embodiment, one or more kinds of elements selected from a group consisting of Si, P, Cu, Sn, Ti, Zr, V, Nb, Mo, and Ga is preferably added to the magnetic alloy powder.

In a preferred embodiment, an intrinsic coercive force $H_{cJ}$ is approximately 400 kA/m or more.

Another preferred embodiment of the present invention provides a production method of magnetic alloy powder for a permanent magnet, wherein a molten alloy including R of about 20 mass percent to about 40 mass percent (R is Y, or at least one type of rare earth element); T of about 60 mass percent to about 79 mass percent (T is a transition metal including Fe as a primary component); and Q of about 0.5 mass percent to about 2.0 mass percent (Q is an element including B (boron) and C (carbon)) is atomized into a non-oxidizing atmosphere, thereby forming the powder.

In a preferred embodiment, a ratio of a content of C to a total content of B and C is preferably within a range of about 0.05 to about 0.90.

Preferably, the powder is spherical.

In a preferred embodiment, heat treatment at temperatures of about 500° C. to about 800° C. may be performed for the powder.

Alternatively, the permanent magnet of the present invention is manufactured from the magnetic alloy powder for a permanent magnet according to preferred embodiments described above.

Alternatively, the method for manufacturing a permanent magnet according to another preferred embodiment of the present invention includes the steps of:

preparing magnetic alloy powder for a permanent magnet produced by the production method of magnetic alloy powder according to one of preferred embodiments described above; and manufacturing a permanent magnet from the magnetic alloy powder for a permanent magnet.

In another preferred embodiment of the present invention, in addition to the compound phase having the $Nd_2Fe_{14}B$ tetragonal system, a second compound phase having a diffraction peak in a position in which lattice spacing d is about 0.295 nm to about 0.300 nm is provided, and a ratio of intensity of the diffraction peak of the second compound phase to a diffraction peak (lattice spacing is about 0.214 nm) with respect to a (410) plane of the compound phase having the $Nd_2Fe_{14}B$ tetragonal system is approximately 10% or more.

Another preferred embodiment of the present invention provides a magnetic alloy powder for a permanent magnet containing:

R of about 20 mass percent to about 40 mass percent (R is Y, or at least one type of rare earth element);

T of about 60 mass percent to about 79 mass percent (T is a transition metal including Fe as a primary component); and Q of about 0.5 mass percent to about 2.0 mass percent (Q is an element including B (boron), C (carbon), S (sulfur), P (phosphorus), and/or Si (silicon)), wherein the magnetic alloy powder is formed by an atomize method, the shape of particles of the powder being spherical, the magnetic alloy powder includes a compound phase having $Nd_2Fe_{14}B$ tetragonal system as a primary composition phase, and a ratio of the content of B relative to a total content of Q is within a range of about 0.10 to about 0.95.

A further preferred embodiment of the present invention provides a production method of magnetic alloy powder for a permanent magnet, including forming a molten alloy containing R of about 20 mass percent to about 40 mass percent (R is Y, or at least type of rare earth element); T of about 60 mass percent to about 79 mass percent (T is a transition metal including Fe as a primary component); and Q of about 0.5 mass percent to about 2.0 mass percent (Q is an element including B (boron), C (carbon), S (sulfur), P (phosphorus), and/or Si (silicon)), and essentially containing B having a ratio of content to a total content of Q of about 0.10 to about 0.95, and atomizing the molten alloy into a non-oxidizing atmosphere to form the magnetic alloy powder.

Other features, processes, steps, characteristics of the present invention will become apparent from the following detailed description of preferred embodiments of the present invention with reference to the attached drawings.

BRIEF DESCRIPTION OF THE DRAWINGS

The foregoing summary as well as the following detailed description of the preferred embodiments of the invention, will be better understood when read in conjunction with the appended drawings. For the purpose of illustrating the invention, there is shown in the drawings preferred embodiments, which are presently preferred. It should be understood, however, that the invention is not limited to the precise arrangements and instrumentalities shown. In the drawings.

DETAILED DESCRIPTION OF THE INVENTION

Figure 1:
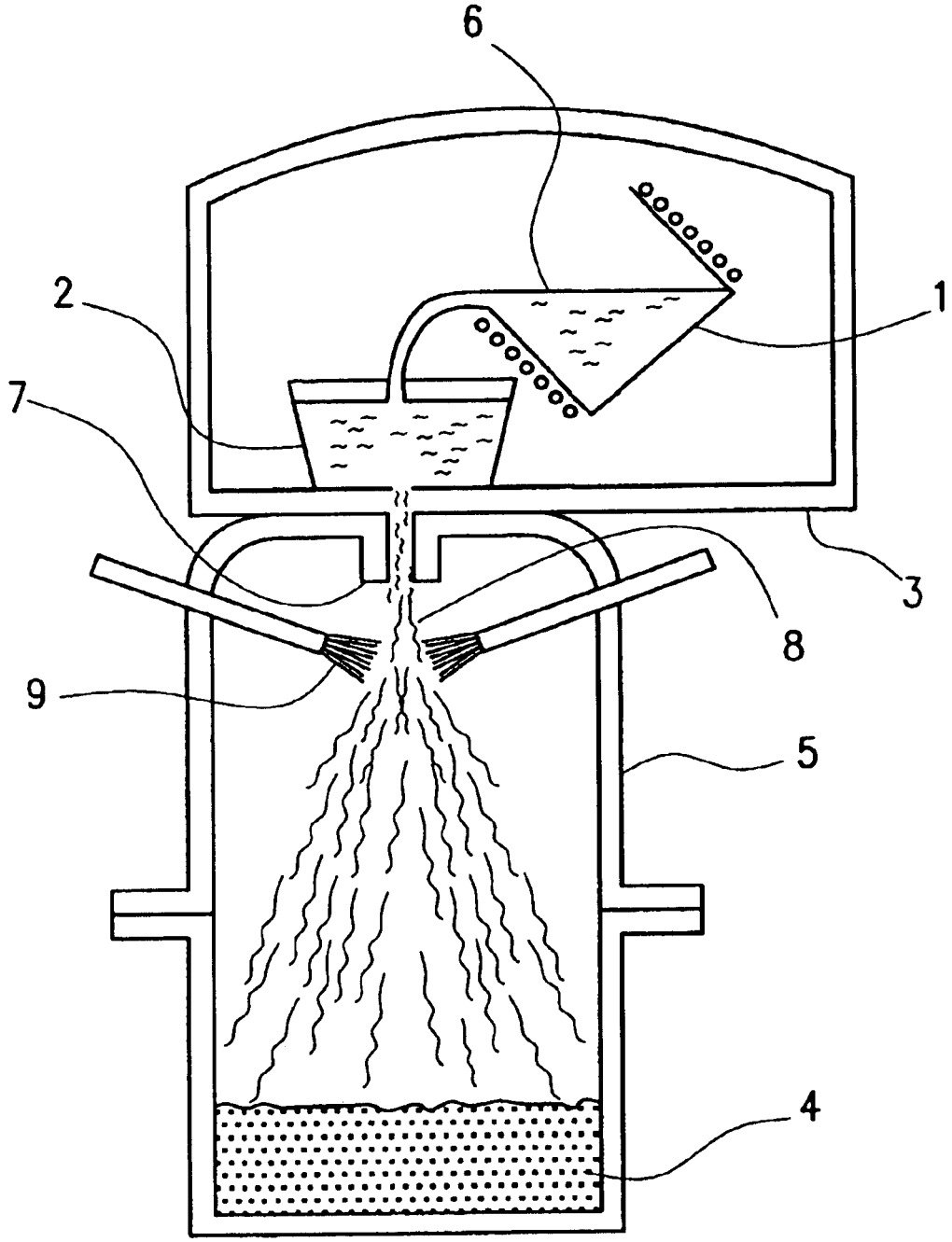
FIG. 1 is a view illustrating a configuration of a gas atomize apparatus used in a preferred embodiment of the present invention.

The inventors of the present invention discovered that when magnetic powder of Nd—Fe—B type rare earth magnet alloy was produced by an atomize method, if carbon (C) was substituted for part of boron (B) of the Nd—Fe—B type rare earth magnet alloy, a high coercive force could be stably and reliably achieved in a wide range of particle sizes, and thus, the inventors conceived of and developed the preferred embodiments of the present invention.

The reason why the coercive force is improved by substituting carbon for part of boron of Nd—Fe—B type rare earth magnet alloy is as follows. Since the quench-ability (or amorphous generating performance) of alloy is increased by the introduction of carbon, it becomes difficult to cause the crystal structure to be coarse even in the same quenching conditions, and the fine crystal structure is attained.

According to preferred embodiments of the present invention, sufficient cooling of magnetic powder can be attained only by a general atomizing process without spraying or applying the molten alloy particles against a special cooling plate, so that the shape of magnetic powder is not compressed and is reliably maintained as spherical. Therefore, it is possible to obtain powder with superior flowability and very high coercive force.

As described above, according to preferred embodiments of the present invention, the crystallization process during quenching is varied by substituting carbon for part of boron, thereby attaining a finer magnetic powder structure. Thus, it is unnecessary to significantly or radically change the process conditions and apparatus for gas atomizing from the conventional conditions and apparatus.

It is known that, in a Nd—Fe—B type magnet, carbon can be substituted for part of boron. The fact that powder of Nd—Fe—B alloy including carbon can be produced by a gas atomize method is described in, for example, Japanese Laid-Open Patent Publications Nos. 1-8205 and 2-70011. However, it has not been known at all or even suggested that the substitution of carbon for boron can be done in a manner that achieves very significant increases in the coercive force produced in the atomize method, and the inventors of the present invention first discovered this fact.

In the case where a magnetic alloy with high coercive force is produced from a molten alloy for a Nd—Fe—B type rare earth magnet by strip casting, or other suitable process, there is no necessity that carbon is substituted for part of boron. However, in the case where powder of Nd—Fe—B type rare earth magnet alloy was produced by the gas atomize method, it was impossible to produce powder with a coercive force at a practical level without applying carbon.

As for the Nd—Fe—B alloy to which carbon is not applied, the viscosity of the molten alloy is high. When the gas atomize method is performed, clogging often occurs in a path for supplying the molten alloy in the gas atomize apparatus. It is necessary to repeatedly suspend the gas atomizing process for performing maintenance and cleaning the path of molten alloy supply. On the contrary, as for the molten alloy having a composition according to preferred embodiments of the present invention, the viscosity thereof is greatly decreased due to the addition of carbon. Thus, the atomizing process of preferred embodiments of the present invention is performed smoothly and without interruption by using the gas atomize apparatus, and the production efficiency is significantly increased.

In order to attain the novel effects due to the unique substitution of carbon, in preferred embodiments of the present invention, the total content (B+C) of the boron and carbon is within the range of about 0.5 mass % to about 2.0 mass %, and the ratio of carbon (C/(B+C)) is in the range of about 0.05 to about 0.90.

For part of Fe, one or more kinds of elements selected from a group consisting of Co, Ni, Mn, Cr, and Al may be substituted. Furthermore, one or more kinds of elements selected from a group consisting of S, P, Si, Cu, Sn, Ti, Zr, V, Nb, Mo, and Ga may be added. Especially, the addition of S, P, and/or Si is preferable, because the viscosity of the molten alloy is decreased, and the atomized powder particles become much finer and the particle size distribution curve is significantly increased in sharpness. When the particle size of atomized powder is made to be small, the cooling progresses at a sufficient speed even in a center portion of each powder particle, so that the structure of the powder particle is much finer, and the coercive force is greatly increased. In addition, when the particle size is made to be small, the powder flowability is improved, so as to be suitably used for injection molding. On the other hand, Ti, Zr, V, Nb, and/or Mo combine with B or C, and function as a solidification nuclei or embryos in quenching, so as to contribute to making the crystal structure of the particles very fine.

Hereinafter, specific preferred embodiments of the present invention will be described.

FIG. 1 shows an exemplary configuration of a gas atomize apparatus which can be suitably used in preferred embodiments of the present invention. The apparatus shown in FIG. 1 preferably includes a melting furnace 1 which can be tilted, a melting chamber 3 including a reservoir 2 such as a tundish, and a quenching chamber 5 in which magnetic powder 4 is formed by gas atomizing. Both of the melting chamber 3 and the quenching chamber 5 are suitably filled with an inert gas atmosphere (argon or helium).

In the melting furnace 1, molten alloy 6 having the above-described composition is produced, and poured into the reservoir 2. A nozzle 7 is disposed in a bottom portion of the reservoir 2, and molten metal flow 8 of the molten alloy 6 is introduced into the interior of the quenching chamber 5 through the nozzle 7. In the quenching chamber 5, a jet 9 is sprayed to the molten metal flow 8, thereby forming small drops of molten alloy. The small drops lose the heat thereof by an atmospheric gas during the free fall, so as to be quenched. The small drops of metal which are solidified by the quenching are collected as magnetic powder 4 in a bottom portion of the gas atomize apparatus.

In this preferred embodiment, heat treatment for the magnetic powder produced by the above-described gas atomize apparatus is performed in argon (Ar) gas atmosphere. Preferably, the temperature elevating speed is in the range of about 0.08° C./sec. to about 15° C./sec., and the magnetic powder is held at temperatures of about 500° C. to about 800° C. for a period of time of about 30 seconds to about 60 minutes. Thereafter, the magnetic powder is cooled up to the room temperature. By the heat treatment, a phase which is not perfectly crystallized and is substantially amorphous during the gas atomizing process is crystallized. It is possible to grow $R_2Fe_{14}B$ crystal phase.

In order to prevent the alloy from being oxidized, the heat treating atmosphere is preferably an inert gas such as Ar gas or $N_2$ gas of approximately 50 kPa or less. Alternatively, the heat treatment may be performed in vacuum of about 0.1 kPa or less.

As for the magnetic powder of this preferred embodiment, the oxidation resistance is increased by the addition of carbon, so that the heat treatment may be performed in the air atmosphere. The magnetic powder of this preferred embodiment already has a spherical shape at a crystallization stage by the atomizing, and is not subjected to mechanical pulverization process thereafter. For this reason, the total surface area of the powder particles per unit mass of the powder is much smaller than that of pulverized powder. Accordingly, the magnetic powder of this preferred embodiment has an advantage that it is difficult to be oxidized when it is in contact with the air in other processes.

When a bonded magnet is manufactured, the magnetic powder of various preferred embodiments of the present invention is preferably mixed with an epoxy resin or a nylon resin, and compacted so as to have a desired shape, At this time, another kind of magnetic powder such as Sm—T—N type magnetic powder or a hard ferrite magnetic powder, for example, may be mixed with the magnetic powder of preferred embodiments of the present invention.

Various types of rotating machines such as a motor, an actuator, and or other suitable apparatus can be produced by using the above-described bonded magnet.

In the case where the magnetic powder is used for a bonded magnet by injection compacting, the magnetic powder is preferably classified so that a medium particle size $D_{50}$ (in this specification simply referred to as "a particle size") is approximately 150 $\mu$m or less. More preferably, an average particle size of magnetic powder is about 1 $\mu$m to about 100 $\mu$m. Even more preferably, the range of the average particle size is about 5 $\mu$m to about 50 $\mu$m. In the case where the magnetic powder is used for a bonded magnet by compression compacting, it is sufficient that the particle size is about 300 μm or less. In this case, the classification is not required. More preferably, the average particle size of the powder is about 5 μm to about 200 μm. Even more preferably, the range is about 5 μm to about 150 μm.

A sintered magnet can be manufactured by using the magnetic powder of preferred embodiments of the present invention. In this case, for example, a compact of the magnetic powder is produced by using a known pressing apparatus, and then the compact is sintered.

In the case where a molten alloy of a material alloy for Nd—Fe—B type rare earth magnet to which carbon is not added is powdered by gas atomizing process, the coercive force is varied strongly depending on the size of a powder particle, as described below. In more detail, the larger the diameter of powder particle is, the smaller the intrinsic coercive force $H_{cJ}$ is. This is because larger powder particles are insufficiently cooled during the atomizing process, so that the crystal structure is coarse. For this reason, the powder produced from a conventional Nd—Fe—B alloy to which carbon is not added by the gas atomize method is required to be classified and filtered by a sieve, and an adjustment of particle size distribution must be performed so as not to include larger particles.

On the contrary, in preferred embodiments of the present invention, the amorphous generating performance of the alloy is greatly improved by the addition of carbon, so that particles having larger particle sizes can be sufficiently quenched. As a result, a very high coercive force is exerted. Therefore, without classifying the powder obtained by the gas atomizing process, it is possible to use the powder for the manufacturing of a bonded magnet or a sintered magnet.

Hereinafter specific examples of preferred embodiments of the present invention will be described.

In this example of preferred embodiments, mother alloys having various compositions in Table 1 shown below were used, and molten alloys were atomized in an Ar gas atmosphere, so as to produce powder having spherical particles. Temperatures of the molten alloy in atomizing were about 1400° C. to about 1500° C. The temperature of the Ar gas atmosphere was about 30° C.

Next, the resultant powder was classified by a sieve, and powder having particle sizes of about 38 μm to about 63 μm was obtained. Thereafter, the magnetic properties (the residual magnetic flux density $B_r$ and the coercive force $H_{cJ}$) of the powder were evaluated. The evaluated results for Samples Nos. 1 to 20 are shown in Table 1. Values in Table 1 were measured by a Vibrating Sample Magnetometer.

TABLE 1

| No. | Composition (mass %) | Magnetic Properties Br (T) | HcJ (MA/m) |
|---|---|---|---|
| 1 | 30.0Nd-69.0Fe-0.5B-0.5C | 0.778 | 0.850 |
| 2 | 28.0Nd-69.0Fe-2.0Co-0.5B-0.5C | 0.804 | 0.814 |
| 3 | 22.0Nd-8.0Pr-69.0Fe-0.6B-0.4C | 0.782 | 0.985 |
| 4 | 25.0Nd-3.0Dy-70.8Fe-0.6B-0.6C | 0.766 | 1.152 |
| 5 | 29.0Nd-3.0Pr-66.5Fe-0.3Al-0.7B-0.4C-0.1Si | 0.778 | 0.912 |
| 6 | 29.0Nd-3.0Pr-66.7Fe-0.2Cu-0.7B-0.3C-0.1P | 0.760 | 0.896 |
| 7 | 32.0Nd-67.0Fe-0.95B-0.05C | 0.774 | 0.775 |
| 8 | 32.0Nd-67.0Fe-0.9B-0.1C | 0.776 | 0.810 |
| 9 | 32.0Nd-67.0Fe-0.1B-0.9C | 0.744 | 0.744 |
| 10 | 30.0Nd-69.0Fe-0.5Sn-0.3B-0.2C | 0.774 | 0.712 |
| 11 | 30.0Nd-68.5Fe-0.2Sn-0.4B-0.9C | 0.745 | 0.916 |

TABLE 1-continued

| No. | Composition (mass %) | Magnetic Properties Br (T) | HcJ (MA/m) |
|---|---|---|---|
| 12 | 30.0Nd-67.5Fe-0.5Ti-0.8B-1.2C | 0.738 | 0.753 |
| 13 | 32.0Nd-59.6Fe-6.0Co-1.0Zr-0.9B-0.5C | 0.742 | 0.688 |
| 14 | 31.0Nd-60.5Fe-6.0Co-1.0V-0.8B-0.7C | 0.734 | 0.768 |
| 15 | 31.0Nd-60.5Fe-6.0Co-0.5Nb-0.5Mo-1.0B-0.5C | 0.730 | 0.829 |
| 16 | 30.0Nd-68.5Fe-0.5Ga-0.6B-0.4C | 0.772 | 0.962 |
| 17 | 30.0Nd-69.0Fe-1.0B | 0.560 | 0.492 |
| 18 | 22.0Nd-8.0Pr-69.0Fe-1.0B | 0.660 | 0.595 |
| 19 | 30.0Nd-69.0Fe-1.0C | 0.433 | 0.256 |
| 20 | 30.0Nd-68.5Fe-0.5Ga-1.0B | 0.548 | 0.562 |

Figure 2A:
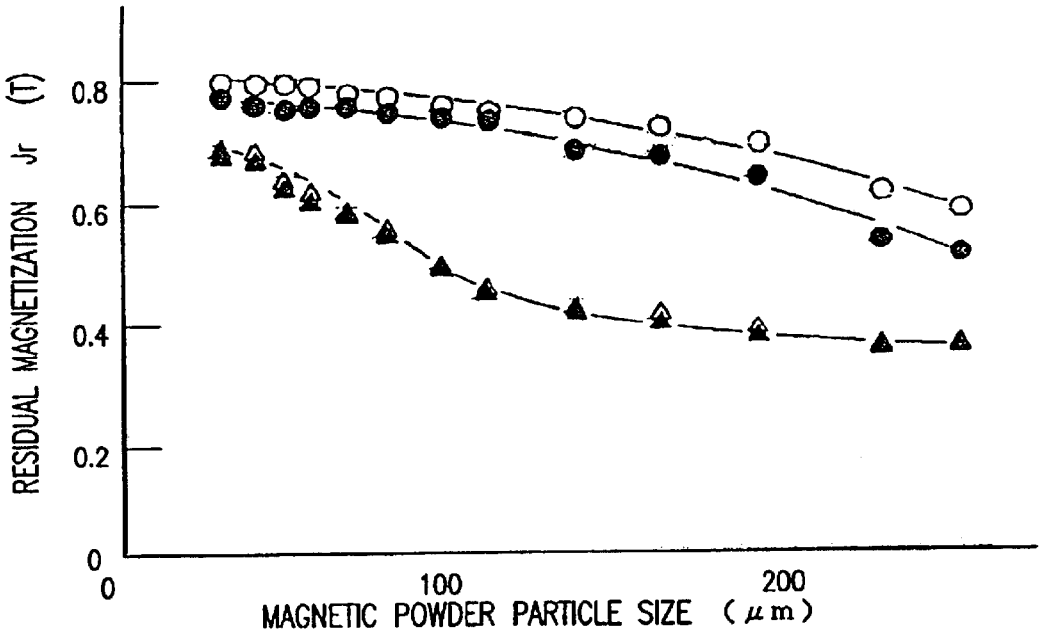
FIG. 2A is a graph showing dependency of residual magnetization Jr (or residual magnetic flux density $B_r$) on powder particle size before and after heat treatment in Sample No. 1 (Example) and Sample No. 17 (Comparative Example)
Figure 2B:
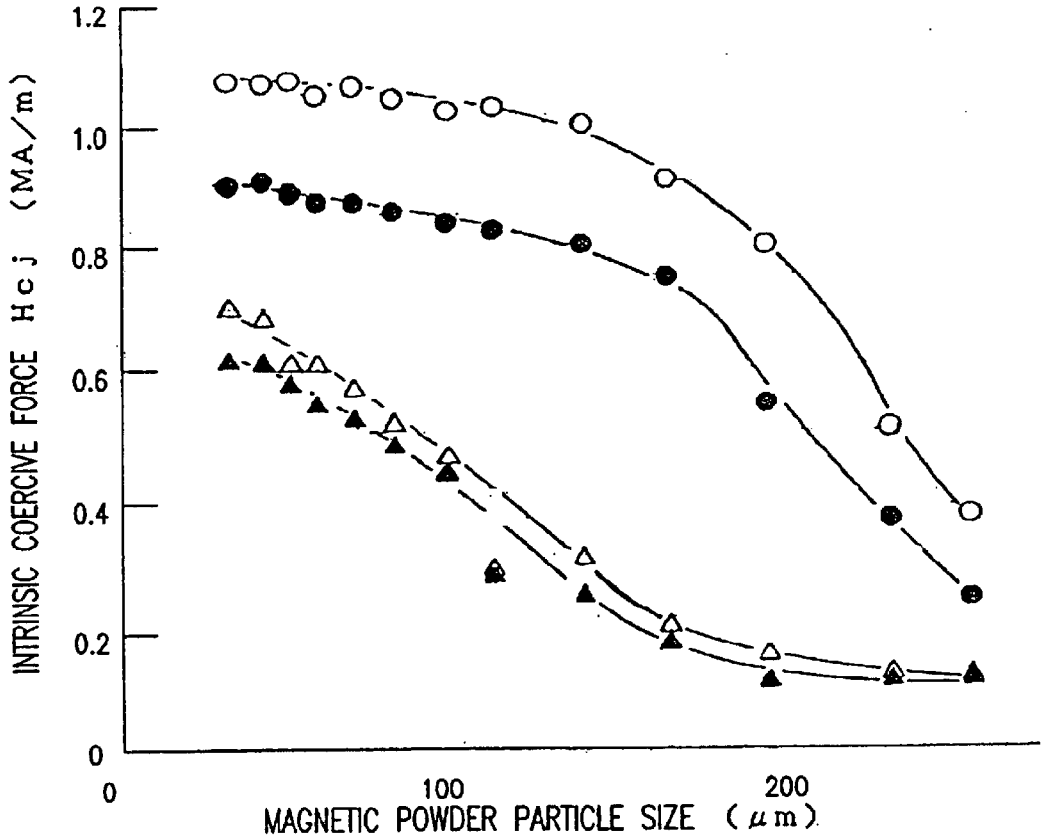
FIG. 2B is a graph showing dependency of intrinsic coercive force $H_{cJ}$ on powder particle size before and after heat treatment in Sample No. 1 (Example) and Sample No. 17 (Comparative Example)

In the samples, Samples Nos. 1 to 16 are examples of preferred embodiments of the present invention, and Samples Nos. 17 to 20 are comparative examples. As for Sample No. 1 (the example) and Sample No. 17 (the comparative example), after the heat treatment was performed at about 600° C. for 5 minutes in an Ar atmosphere, magnetic properties were measured for respective particle sizes. FIGS. 2A and 2B show dependencies, on powder particle size, of the magnetic properties (the residual magnetization $J_r$ and the intrinsic coercive force $H_{cJ}$) before and after the heat treatment for Sample No. 1 (the example) and Sample No. 17 (the comparative example), respectively. In the graphs, data indicated by "●" and "○" represent the magnetic properties before the heat treatment and the magnetic properties after the heat treatment of Sample No. 1, respectively. Data indicated by "▲" and "Δ" represent the magnetic properties before the heat treatment and the magnetic properties after the heat treatment of Sample No. 17, respectively.

As is seen from FIGS. 2A and 2B, in the case of the magnetic powder of the example (Sample No. 1), high coercive force is attained in a wide range of particle size of about 210 μm or less. On the contrary, in the case of the comparative example (Sample No. 17), high coercive force can be attained only for particle sizes of 106 μm or less.

It is very difficult to mass-produce powder particles having diameters of about 100 μm or less by the gas atomize method. Accordingly, if a permanent magnet with high coercive force is to be produced by the powder of the comparative example, it is necessary to remove coarse magnetic powder having a relatively low coercive force by classifying the powder formed by the gas atomize method. Such classification greatly lowers the production yield.

As is seen from FIG. 2B, in the example of preferred embodiments of the present invention, the smaller the particle size is, the higher the coercive force is. Accordingly, also in preferred embodiments of the present invention, magnetic powder of smaller particle sizes is preferred. Specifically, it is preferred that the particle sizes be about 200 μm or less. It is more preferred that the particle sizes be about 150 μm or less.

Next, bonded magnets were manufactured by using the powder of Sample No. 3 (the example) and Sample No. 18 (the comparative example). The particle sizes of the used magnetic powder were about 106 μm or less, and the particle size distribution was not adjusted.

Figure 3:
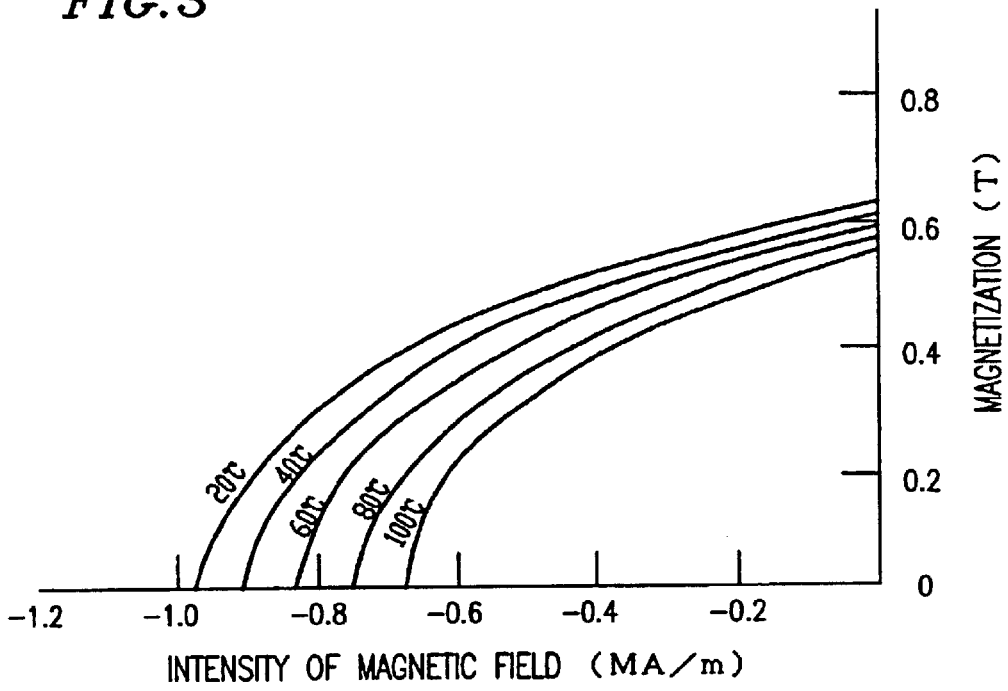
FIG. 3 is a graph showing magnetic properties (demagnetization curve at various temperature) for a bonded magnet of Sample No. 3 (Example)
Figure 4:
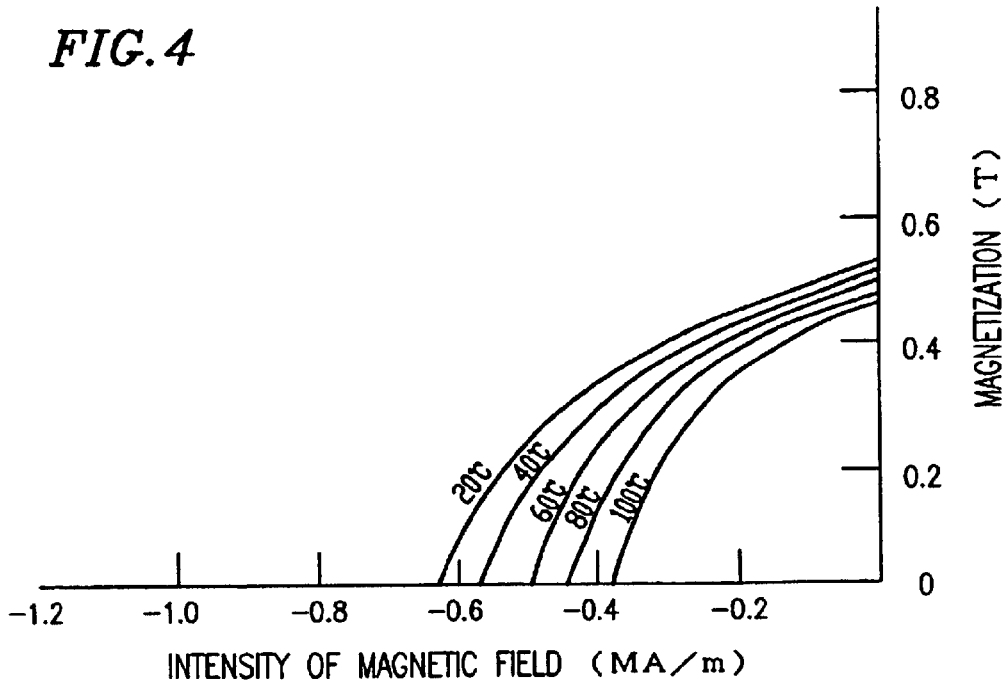
FIG. 4 is a graph showing magnetic properties (demagnetization curve at various temperature) for a bonded magnet of Sample No. 18 (Comparative Example)

The evaluation of the magnetic properties of the bonded magnets was performed by a BH tracer. FIG. 3 shows the magnetic properties (the demagnetization curve) measured for the bonded magnet of Sample No. 3. FIG. 4 shows the magnetic properties (the demagnetization curve) measured for the bonded magnet of Sample No. 18.

From the demagnetization curves at respective temperatures shown in FIGS. 3 and 4, temperature coefficients of the residual magnetization $J_r$ (=residual magnetic flux density $B_r$) and the intrinsic coercive force $H_{cJ}$ in the range of about 20° C. to about 100 ° C. were calculated. The results are shown in Table 2 below.

TABLE 2

| Sample | Temperature Coefficient (20~100° C.) (%/° C.) α[Br] | β[HcJ] |
|---|---|---|
| Example (Powder No. 3) | −0.138 | −0.380 |
| Comparative Example (Powder No. 18) | −0.130 | −0.468 |

As is seen from Table 2, the temperature coefficient of the intrinsic coercive force $H_{cJ}$ is reduced due to the addition of carbon.

Figure 5:
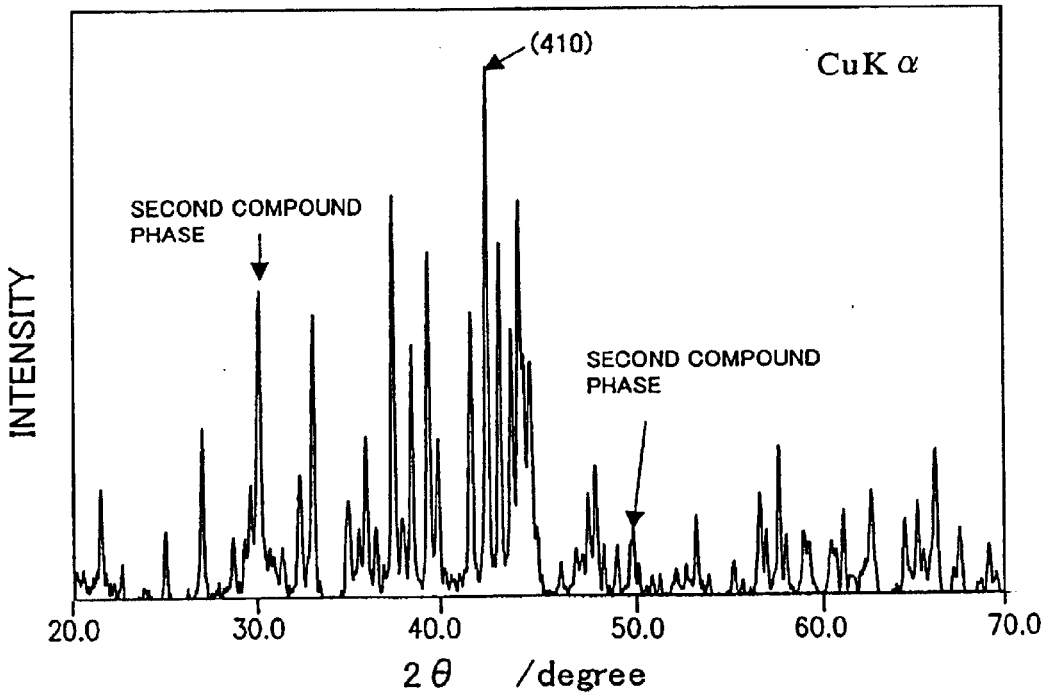
FIG. 5 is a graph showing X-ray diffraction pattern from powder before heat treatment for crystallization obtained for the Example, the axis of abscissa representing diffraction angle (2θ) and the axis of ordinates representing a diffraction intensity.
Figure 6:
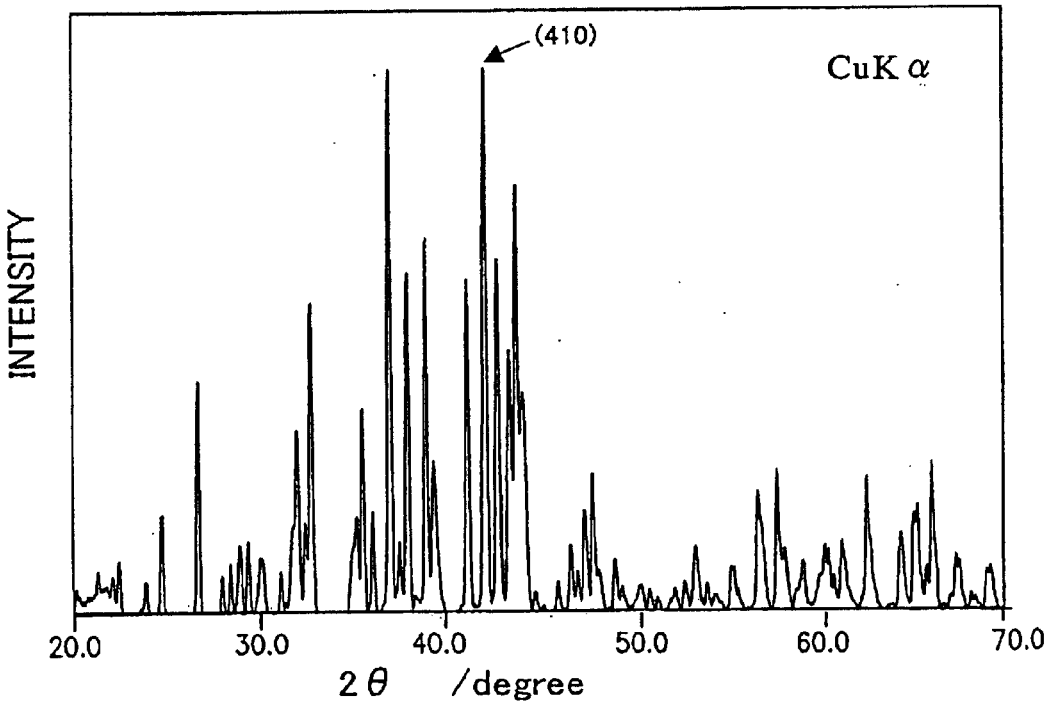
FIG. 6 is a graph showing X-ray diffraction pattern from powder before heat treatment for crystallization obtained for the Comparative Example, the axis of abscissa representing diffraction angle (2θ) and the axis of ordinates representing a diffraction intensity.

Next, X-ray diffraction data were obtained for the magnetic powder of the example and the comparative example. FIG. 5 is a graph showing the powder X-ray diffraction pattern before the heat treatment for crystallization obtained for the example, FIG. 6 is a graph showing the powder X-ray diffraction pattern before the heat treatment for crystallization obtained for the comparative example. The axis of abscissa represents a diffraction angle (2θ), and the axis of ordinates represents an intensity of diffraction peak.

From the X-ray diffraction data shown in FIG. 5 and the like, it is seen that the magnetic alloy powder of preferred embodiments of the present invention includes a second compound phase showing an intensive X-ray diffraction peak at lattice spacing d of about 0.295 to about 0.300 nm. In addition, in the vicinity of the lattice spacing of about 0.18 nm, a diffraction peak which might be caused by the second compound phase was observed. The positions of the diffraction peaks correspond to the vicinity of 2θ=30 degrees and the vicinity of 2θ=50 degrees in the case where an X-ray source is CuKα rays, respectively. The diffraction peaks caused by the second compound phase are more remarkably observed when the heat treatment at temperatures of about 500° C. to about 800° C. is performed for the magnetic powder. This shows that when an amorphous phase existing before the heat treatment is crystallized, both of the primary phase and the second compound phase are grown.

The above-mentioned diffraction peak of the second compound phase has an intensity of about 10% to about 200% with respect to the diffraction peak (lattice spacing of approximately 0.214 nm) related to a (410) plane of a compound phase having a $Nd_2Fe_{14}B$ type tetragonal structure.

Preferred embodiments of the present invention are described with respect to the gas atomize method. Alternatively, magnetic powder of the present invention may be produced by using another atomize method (for example, a centrifugal atomize method, or other suitable method).

It is preferred that the shape of powder particles immediately after the atomizing process is spherical, but the spherical shape is not always required. In the case where the shape of powder particles is not spherical, the powder flowability is lowered, but the effects that the weather resistance and the oxidation resistance are improved due to the addition of carbon can be sufficiently attained.

In another example of preferred embodiments, mother alloys having various compositions shown in Table 3 below were used, so as to produce atomized powder in the same conditions as those of the examples of preferred embodiments described above. The resultant atomized powder was classified by a sieve, and powder having particle sizes of about 38 μm to about 63 μm was obtained. Thereafter, the magnetic properties (the residual magnetic flux density $B_r$ and the coercive force $H_{cJ}$) of the powder were evaluated. The evaluation results are shown in Table 3 for Samples Nos. 21 to 24.

TABLE 3

| No. | Composition (mass %) | Magnetic Properties Br (T) | HcJ (MA/m) |
|---|---|---|---|
| 21 | 30.0Nd-69.0Fe-0.98B-0.1S | 0.765 | 0.805 |
| 22 | 30.0Nd-68.8Fe-1.0B-0.2Si | 0.761 | 0.821 |
| 23 | 30.0Nd-68.8Fe-0.8B-0.2C-0.2S | 0.755 | 0.845 |
| 24 | 30.0Nd-68.9Fe-1.0B-0.4P | 0.771 | 0.810 |

In this example of preferred embodiments, B was essentially included. In addition to B, C, S, P or Si was added. In this example of preferred embodiments, powder was obtained by quenching a molten alloy including Q (Q is an element including B, C, S, P and/or Si) of about 0.5 mass percent to about 2.0 mass percent by an atomize method. A content ratio of B to the total content of Q is about 0.10 to about 0.95.

From Table 3, it is seen that superior magnetic properties are achieved in this example of preferred embodiments of the present invention.

In another example of preferred embodiments, powder was produced by quenching respective alloys of Samples Nos. 1, 3, 17, 18, 21, 22, and 24 shown in Table 1 and Table 3 by an atomize method. The temperature of the molten alloy in atomizing was about 1500° C., and other atomizing conditions were set in common for respective samples. Then, a mass ratio (a collection rate) of fine powder (particle sizes: about 63 μm or less) included in the obtained atomized powder to the whole powder was measured. The results are shown in Table 4 below.

TABLE 4

| | Mass Ratio (Collection Rate) of Powder Particles having Particle sizes of about 63 μm or less [%] |
|---|---|
| 1 | 75.8 |
| 3 | 74.0 |
| 17 | 63.5 |
| 18 | 61.7 |
| 21 | 83.7 |
| 22 | 89.4 |
| 24 | 78.1 |

As is seen from Table 4, as for Samples Nos. 1, 3, 21, 22, and 24, the collection rates are approximately 70% or more, and are remarkably higher than the collection rates of Samples Nos. 17 and 18 of the comparative examples. This shows that the addition of C, S, P, and/or Si contributes to the reduction in particle size of atomized powder The main reason why the particle size is reduced is that the viscosity of the molten alloy in atomizing is greatly decreased due to an appropriate amount of added element.

According to various preferred embodiments of the present invention, without significantly changing the process conditions of the gas atomize method, high coercive forces are achieved with a wide range of particle sizes, so that the produced powder is highly effective and advantageous for use as a material for a bonded magnet. In conjunction with low-temperature sintering technique such as a hot press method, a sintered magnet can be obtained. In addition, when hot working is used, a magnetically anisotropic magnet can be obtained.

In preferred embodiments of the present invention, carbon is essentially included, so that it is unnecessary to exclude the mixing of carbon into the alloy. Therefore, it is unnecessary to perform a special process for removing carbon, and failed components in the course of processes and collected magnet products can be directly molten again and used again. In addition, due to the inclusion of carbon, the weather resistance is advantageously superior.

According to preferred embodiments of the present invention, the coercive force is hardly changed depending on temperatures, and the resistance to irreversible heat demagnetization is very high. Since the shape of magnetic powder is spherical, the flowability is superior, and the compaction efficiency is greatly improved. Accordingly, the material filling speed is increased, and the filling time is greatly reduced. Thus, it is possible to dramatically reduce a press cycle time. In addition, the filling accuracy in compaction can be increased, and the size accuracy of products can be improved, so that mechanical processing after the compaction can be eliminated.

In addition, since the added carbon lowers the oxidation reactivity of the rare earth magnet, the magnet properties will not be deteriorated by heating or firing during the production process, nor will the safety of process be reduced or affected. Moreover, without providing any special protection film for improving the weather resistance on a surface of the magnet, it is possible to improve the weather resistance and the magnet from deteriorating with the passage of time.

While the present invention has been described with respect to preferred embodiments thereof it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. Magnetic alloy powder for a permanent magnet containing:

R of about 20 mass percent to about 40 mass percent (R is Y or at least type of rare earth element);

T of about 60 mass percent to about 79 mass percent (T is a transition metal including Fe as a primary component); and Q of about 0.5 mass percent to about 2.0 mass percent (Q is an element including B (boron) and C (carbon)), wherein the magnetic alloy powder is formed by an atomize method, the shape of particles of the powder being substantially spherical, the magnetic alloy powder includes a first compound phase having $Nd_2Fe_{14}B$ tetragonal structure as a primary composition phase and a second compound phase having a diffraction peak in a position in which lattice spacing d is about 0.295 nm to about 0.300 nm, and a ratio of a content of C to a total content of B and C is about 0.05 to about 0.90.

2. The magnetic alloy powder as set forth in claim 1, wherein one or more elements selected from a group consisting of Co, Ni, Mn, Cr, and Al are substituted for part of Fe included in T.

3. The magnetic alloy powder as set forth in claim 1, wherein one or more elements selected from a group consisting of Si, P, Cu, Sn, Ti, Zr, V, Nb, Mo, and Ga is added.

4. The magnetic alloy powder as set forth in claim 1, wherein an intrinsic coercive force $H_{cJ}$ is approximately 400 kA/m or more.

5. A production method of magnetic alloy powder for a permanent magnet including the steps of forming a molten alloy including R of about 20 mass percent to about 40 mass percent (R is Y or at least one type of rare earth element); T of about 60 mass percent to about 79 mass percent (T is a transition metal including Fe as a primary component); and Q of about 0.5 mass percent to about 2.0 mass percent (Q is an element including B (boron) and C (carbon)), and atomizing the molten alloy into a non-oxidizing atmosphere to produce the magnetic alloy powder, said magnetic alloy powder including a first compound phase having $Nd_2Fe_{14}B$ tetragonal structure as a primary composition phase and a second compound phase having a diffraction peak in a position in which lattice spacing d is about 0.295 nm to about 0.300 nm.

6. The production method of magnetic alloy powder as set forth in claim 5, wherein a ratio of a content of C to a total content of B and C is about 0.05 to about 0.90.

7. The production method of magnetic alloy powder as set forth in claim 5, wherein the powder is substantially spherical.

8. The production method of magnetic alloy powder as set forth in claim 7, wherein heat treatment at a temperature of about 500° C. to about 800° C. is performed for the powder.

9. A permanent magnet manufactured from the magnetic alloy powder for a permanent magnet as set forth in claim 1.

10. A method for manufacturing a permanent magnet comprising the steps of:

preparing magnetic alloy powder for a permanent magnet produced by the production method of magnetic alloy powder as set forth in claim 5; and manufacturing a permanent magnet from the magnetic alloy powder for a permanent magnet.

11. The magnetic alloy power as set forth in claim 1, wherein, in addition to the compound phase having the $Nd_2Fe_{14}B$ tetragonal structure, a second compound phase having a diffraction peak in a position in which lattice spacing d is about 0.295 nm to about 0.300 nm is contained, and a ratio of intensity of the diffraction peak of the second compound phase to a diffraction peak (lattice spacing is approximately 0.214 nm) with respect to a (410) plane of the compound phase having the $Nd_2Fe_{14}B$ tetragonal structure is about 10% or more.

12. Magnetic alloy powder for a permanent magnet containing:

R of about 20 mass percent to about 40 mass percent (R is Y or at least one type of rare earth element);

T of about 60 mass percent to about 79 mass percent (T is a transition metal including Fe as a primary component); and Q of about 0.5 mass percent to about 2.0 mass percent (Q is an element including B (boron), C (carbon), S (sulfur), P (phosphorus), and/or Si (silicon)), wherein the magnetic alloy powder is formed by an atomize method, the shape of particles of the powder being spherical, the magnetic alloy powder includes a first compound phase having $Nd_2Fe_{14}B$ tetragonal structure as a primary composition phase and a second compound phase having a diffraction peak in a position in which lattice spacing d is about 0.295 nm to about 0.300 nm, and a ratio of a content of B to a total content of Q is about 0.10 to about 0.95.

13. A production method of magnetic alloy powder for a permanent magnet, including the steps of forming a molten alloy containing R of about 20 mass percent to about 40 mass percent (R is Y or at least one type of rare earth element); T of about 60 mass percent to about 79 mass percent (T is a transition metal including Fe as a primary component); and Q of about 0.5 mass percent to about 2.0 mass percent (Q is an element including B (boron), C (carbon), S (sulfur), P (phosphorus), and/or Si (silicon)), and essentially containing B having a ratio of content to a total content of Q of about 0.10 to about 0.95, and atomizing the molten alloy into a non-oxidizing atmosphere to produce the magnetic alloy powder, said magnetic alloy powder including a first compound phase having $Nd_2Fe_{14}B$ tetragonal structure as a primary composition phase and a second compound chase having a diffraction peak in a position in which lattice spacing d is about 0.295 nm to about 0.300 nm.

* * * * *